United States Patent [19]

Iijima et al.

[11] Patent Number: 4,908,076

[45] Date of Patent: Mar. 13, 1990

[54] FE-B MAGNETS CONTAINING ND-PR-CE RARE EARTH ELEMENTS

[75] Inventors: Kenzaburou Iijima; Takeo Sata, both of Hamamatsu, Japan

[73] Assignee: Yamaha Corporation, Shizuoka, Japan

[21] Appl. No.: 127,765

[22] Filed: Dec. 2, 1987

Related U.S. Application Data

[63] Continuation-in-part of Ser. No. 11,876, Feb. 6, 1987, abandoned, which is a continuation of Ser. No. 724,016, Apr. 17, 1985, abandoned.

[30] Foreign Application Priority Data

Apr. 24, 1984 [JP] Japan ..... 59-82721

[51] Int. Cl.[4] ..... H01F 1/04

[52] U.S. Cl. ..... 148/302; 420/83; 420/121

[58] Field of Search ..... 148/302; 420/83, 121

[56] References Cited

FOREIGN PATENT DOCUMENTS 0101552 2/1984 European Pat. Off. .
56-47538 4/1981 Japan .

*Primary Examiner*—John P. Sheehan
*Attorney, Agent, or Firm*—Sachs & Sachs

[57] ABSTRACT

A rare earth magnet article of the Fe-B type is provided herein characterized by consisting essentially of the three rare earth elements Nd-Pr-Ce in combination within defined atom ratios of each in the formula:

$$(Nd_{1-(p+q)}Pr_pCe_q)_xB_yFe_{1-(x+y)}$$

wherein $0.1 \leqq x \leqq 0.3$, $0.02 \leqq y \leqq 0.09$, $0.1 \leqq p \leqq 0.3$ and $0.02 \leqq q \leqq 0.15$.

The magnet is prepared by a process which assures that the resultant magnet has a coercive force, Hc, of at least about 5kOe, and a residual magnetic flux density, Br, of at least about 10kG, which magnetic properties are substantially the same within the range of the sintering temperatures of the process.

4 Claims, 6 Drawing Sheets

COMPARATIVE TEST SAMPLES:

○ ◎ △ – PRESENT INVENTION 79Fe-GB-12Nd-2Pr-1Ce

• ⊙ ▲ – SAGAWA ET AL 79Fe-GB-15Nd (EPA 0101552; 2/84)

PROCESS CONDITIONS:

AVERAGE PARTICLE DIAMETER OF POWDERS 3μm.
COMPACTING IN MAGNETIC FIELD OF 20,000 G AT PRESSURE OF 5 TONS/cm$^2$
SINTERING FOR 2 HOURS.

FE-B MAGNETS CONTAINING ND-PR-CE RARE EARTH ELEMENTS

CROSS REFERENCE TO RELATED PATENT APPLICATIONS

This application is a continuation-in-part of application Ser. No. 011,876, filed Feb. 6, 1987, now abandoned which was a continuation of application Serial No. 724,016, now abandoned filed Apr. 17, 1985, now abandoned.

BACKGROUND OF THE INVENTION

1. Field of the Invention

The present invention relates to Fe-B rare earth type magnets and a method for producing same, and, more particularly, it relates to the production of high quality Fe-B rare earth type magnets containing Nd-Pr-Ce in combination, and are particularly used for electric and electronic appliances.

2. Description of the Prior Art

Sm-Co type magnets having compositions such as $Sm_5Co$, $Sm_7Co$ and $Sm_2Co_{17}$ have been conventionally known as commercial rare earth type magnets with their excellent magnetic properties, particularly their high maximum magnetic energy product. Y-Co type magnets and Ce-Co type magnets have also been proposed in the field of art. Despite their excellent magnetic properties, the inclusion of a high amount of expensive Co has hampered broader use of these rare earth type magnets. In view of this situation, Fe- rare earth elements type magnets have already been proposed in which inexpensive Fe is used as a substitute for expensive Co. In the case of such rare earth type magnets, it is known that addition of B enhances the magnetic properties. Such Fe-B- rare earth elements type magnets, however, still have inadequate magnetic properties, and, accordingly, there is a strong demand in the market for significant improvement in magnetic properties of Fe-B- rare earth elements type magnets.

SUMMARY OF THE INVENTION

It is an object of the present invention to provide industrial scale production of Fe-B- rare earth element type magnets of extra high quality, in particular having high coercive force.

Another object herein is to provide Fe-B type rare earth magnets which include the combination of Nd-Pr-Ce rare earth within defined atomic ratios of each with advantageous magnetic properties.

According to the present invention, the Fe-B rare earth type magnet of the present invention includes Fe and B, and Nd-Pr-Ce in the following atom ratios:

$$(Nd_{1-(p+q)}Pr_pCe_q)_xB_yFe_{1-(x+y)}$$

wherein $0.1 \leqq x \leqq 0.3$, $0.02 \leqq y \leqq 0.09$, $0.1 \leqq p \leqq 0.3$ and $0.02 \leqq q \leqq 0.15$.

Preferably, x is 0.12 to 0.25; y is 0.04 to 0.08; p is 0.12 to 0.27; and q is 0.04 to 0.12.

The magnets of the present invention are prepared by the steps of casting molten alloy of the above-described composition, comminuting cast blocks to powders of 2.0 to 50 μm average diameter, compacting said powders within a magnetic field and sintering compact block at 950 to 1200 degrees C. for at least 1 to 4 hours.

The resulting magnets herein have a coercive force, Hc, of at least about 5kOe, and a residual magnetic flux density, Br, of at least about 10kG, which magnetic properties are substantially the same within the range of the sintering temperatures.

DETAILED DESCRIPTION OF THE INVENTION

Figure 1:
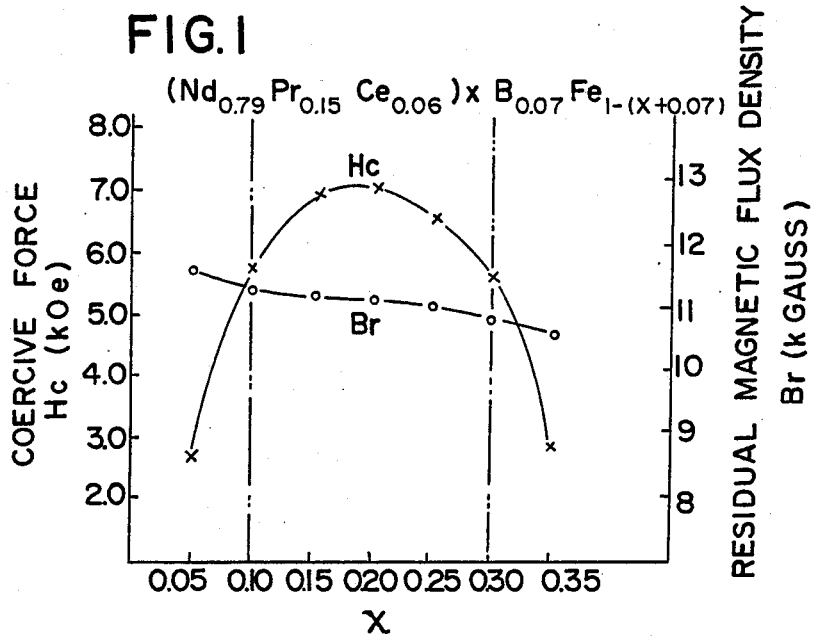
FIG. 1 is a graph for showing the influence of the value of x on the coercive force (Hc) and the residual magnetic flux density (Br) for sintered magnets having compositions $$(Nd_{0.79}Pr_{0.15}Ce_{0.06})_xB_{0.07}Fe_{1-(x+0.07)};$$

As specified above, the rare earth type magnet in accordance with the present invention includes Fe, B and, as rare earth elements, Nd, Pr and Ce. The atom ratio of inclusion between Nd, Pr and Ce is $1-(p+q)$ : p : q, where p is in a range from 0.1 to 0.3 and q is in a range from 0.02 to 0.15. The atom ratio of inclusion between the rare earth elements (Nd, Pr, Ce), B and Fe is $x : y : 1-(x+y)$, where x is in a range from 0.1 to 0.3 and y is in a range from 0.02 to 0.09. By use of such a combination of rare earth elements at the specified atom ratio of inclusion and its specified atom ratio of inclusion with Fe and B, the resultant magnet exhibits a coercive force (Hc) of at least 5k0e and a residual magnetic flux density (Br) of at least 10kG.

Preferably, x is 0.12 to 0.25; y is 0.04 to 0.08; p is 0.12 to 0.27; and q is 0.04 to 0.12, wherein Hc is about 7k0e, and the residual magnetic flux density is about 11kG. Optimally, x is about 0.15; y is about 0.07; p is about 0.15; and q is about 0.08.

When the value of x falls below 0.1, an insufficient coercive force (Hc) is obtained. Similarly, a value of x above 0.3 causes excessive lowering of the coercive force (Hc), as seen from the results of the examples which follow.

The value of y should be in a range from 0.02 to 0.09. Any value below this lower limit causes lowering in coercive force (Hc), whereas any value above this upper limit results in low residual magnetic flux density (Br).

The value of p should be in a range from 0.1 to 0.3. Any value falling outside this range results in low coercive force (Hc).

The value of q should be in a range from 0.02 to 0.15. Any value falling outside this range causes undesirable lowering in level of resultant coercive force (Hc).

In accordance with the present invention, a molten alloy of the above-described composition is first prepared, for example, in a high frequency vacuum furnace. After casting the molten alloy into cast blocks of a proper shape, the cast blocks are comminuted into powders of 2.0 to 50 μm average diameter in a ball or a vibration mill. If the average diameter of the powders fall below 2.0 μm, the residual magnetic flux density (Br) of the final product, i.e. the sintered magnet, does not exceed 10kG. Similarly, an average diameter above 50 μm results in a coercive force (Hc) below 5k0e. Thus, the specified range for the average diameter assures advantageous magnetic properties, that is, the coercive force and residual magnetic flux density values are both at acceptable levels.

Since the powders thus prepared possess magnetic anisotropy, they are next subjected to compaction in a magnetic field for orientation of the powder particles. For this purpose, the intensity of the magnetic field preferably should be 5kOe or higher. The compacted block then is subjected to sintering, which is carried out at a temperature of about 950 degrees to 1200 degrees C. for at least 1 to 4 hours. A sintering temperatures below 950 degrees, an insufficient sintering effect is obtained, and, as a consequence, the magnetic properties, in particular, the residual magnetic flux density, is significantly reduced. The compacted block also is molten at a temperature above 1200 degrees C. Any sintering period shorter than 1 hour provides an insufficient sintering effect whereas sintering periods longer than 4 hours do not improve the magnetic properties. As shown in the accompanying drawings, in particular, FIGS. 8 and 9, the magnetic properties remain substantially the same within the suitable range of sintering temperatures.

After sintering, the anisotropic magnet possesses a coercive force(Hc) of at least 5kOe and a residual magnetic flux density (Br) of at least 10kG. Within the preferred compositional range, the magnet possesses a coercive force (Hc) of 7kOe or higher, and a residual magnetic flux density (Br) or 11kG or higher.

The invention now will be illustrated with reference to the accompanying examples.

EXAMPLE 1

Molten alloys of Samples Nos. 1 to 17 in Table 1 and Samples Nos. 18 to 35 in Table 2 were prepared in a high frequency vacuum furnace for production of cast blocks. Each cast block was comminuted into powders of 10 μm average diameter in a ball mill. The powders then were subjected to compaction at 5 ton/cm$^2$, pressure within a DC magnetic field of 20kG. The compacted block was sintered in an argon gas environment at 1100 degrees C. for 2 hours. A test piece was cut out from the sintered magnet for measurement of magnetic properties.

TABLE 1

| Sample No. | Composition (atom ratio of inclusion) | Magnetic properties: Coercive force Hc (kOe) | Residual magnetic flux density Br (kG) |
|---|---|---|---|
| 1 | $(Nd_{0.79}Pr_{0.15}Ce_{0.06})_{0.05}B_{0.07}Fe_{0.88}$ | 2.7 | 11.7 |
| 2 | $(Nd_{0.79}Pr_{0.15}Ce_{0.06})_{0.10}B_{0.07}Fe_{0.83}$ | 5.8 | 11.4 |
| 3 | $(Nd_{0.79}Pr_{0.15}Ce_{0.06})_{0.15}B_{0.07}Fe_{0.78}$ | 6.9 | 11.3 |
| 4 | $(Nd_{0.79}Pr_{0.15}Ce_{0.06})_{0.20}B_{0.07}Fe_{0.73}$ | 7.0 | 11.2 |
| 5 | $(Nd_{0.79}Pr_{0.15}Ce_{0.06})_{0.25}B_{0.07}Fe_{0.68}$ | 6.5 | 11.1 |
| 6 | $(Nd_{0.79}Pr_{0.15}Ce_{0.06})_{0.30}B_{0.07}Fe_{0.63}$ | 5.6 | 10.8 |
| 7 | $(Nd_{0.79}Pr_{0.15}Ce_{0.06})_{0.35}B_{0.07}Fe_{0.58}$ | 2.8 | 10.6 |
| 8 | $(Nd_{0.79}Pr_{0.15}Ce_{0.06})_{0.15}B_{0.015}Fe_{0.835}$ | 2.8 | 12.5 |
| 9 | $(Nd_{0.79}Pr_{0.15}Ce_{0.06})_{0.15}B_{0.02}Fe_{0.83}$ | 4.0 | 12.6 |
| 10 | $(Nd_{0.79}Pr_{0.15}Ce_{0.06})_{0.15}B_{0.03}Fe_{0.82}$ | 5.6 | 12.5 |
| 11 | $(Nd_{0.79}Pr_{0.15}Ce_{0.06})_{0.15}B_{0.04}Fe_{0.81}$ | 6.2 | 12.3 |
| 12 | $(Nd_{0.79}Pr_{0.15}Ce_{0.06})_{0.15}B_{0.05}Fe_{0.80}$ | 6.6 | 12.0 |
| 13 | $(Nd_{0.79}Pr_{0.15}Ce_{0.06})_{0.15}B_{0.06}Fe_{0.79}$ | 6.8 | 11.5 |
| 14 | $(Nd_{0.79}Pr_{0.15}Ce_{0.06})_{0.15}B_{0.07}Fe_{0.78}$ | 7.0 | 11.3 |
| 15 | $(Nd_{0.79}Pr_{0.15}Ce_{0.06})_{0.15}B_{0.08}Fe_{0.77}$ | 7.0 | 10.5 |
| 16 | $(Nd_{0.79}Pr_{0.15}Ce_{0.06})_{0.15}B_{0.09}Fe_{0.76}$ | 7.0 | 9.5 |
| 17 | $(Nd_{0.79}Pr_{0.15}Ce_{0.06})_{0.15}B_{0.10}Fe_{0.75}$ | 6.8 | 6.5 |

TABLE 2

| Sample No. | Composition (atom ratio of inclusion) | Magnetic properties: Coercive force Hc (kOe) | Residual magnetic flux density Br (kG) |
|---|---|---|---|
| 18 | $(Nd_{0.89}Pr_{0.05}Ce_{0.06})_{0.15}B_{0.07}Fe_{0.78}$ | 3.0 | 12.0 |
| 19 | $(Nd_{0.84}Pr_{0.10}Ce_{0.06})_{0.15}B_{0.07}Fe_{0.78}$ | 5.6 | 11.5 |
| 20 | $(Nd_{0.79}Pr_{0.15}Ce_{0.06})_{0.15}B_{0.07}Fe_{0.78}$ | 7.0 | 11.2 |
| 21 | $(Nd_{0.74}Pr_{0.20}Ce_{0.06})_{0.15}B_{0.07}Fe_{0.78}$ | 7.1 | 11.0 |
| 22 | $(Nd_{0.69}Pr_{0.25}Ce_{0.06})_{0.15}B_{0.07}Fe_{0.78}$ | 7.1 | 11.0 |
| 23 | $(Nd_{0.64}Pr_{0.30}Ce_{0.06})_{0.15}B_{0.07}Fe_{0.78}$ | 5.9 | 10.9 |
| 24 | $(Nd_{0.59}Pr_{0.35}Ce_{0.06})_{0.15}B_{0.07}Fe_{0.78}$ | 3.6 | 10.8 |
| 25 | $(Nd_{0.84}Pr_{0.15}Ce_{0.01})_{0.15}B_{0.07}Fe_{0.78}$ | 3.0 | 11.2 |
| 26 | $(Nd_{0.83}Pr_{0.15}Ce_{0.02})_{0.15}B_{0.07}Fe_{0.78}$ | 5.0 | 11.2 |
| 27 | $(Nd_{0.81}Pr_{0.15}Ce_{0.04})_{0.15}B_{0.07}Fe_{0.78}$ | 6.5 | 11.2 |
| 28 | $(Nd_{0.79}Pr_{0.15}Ce_{0.06})_{0.15}B_{0.07}Fe_{0.78}$ | 7.0 | 11.2 |
| 29 | $(Nd_{0.77}Pr_{0.15}Ce_{0.08})_{0.15}B_{0.07}Fe_{0.78}$ | 7.1 | 11.2 |
| 30 | $(Nd_{0.75}Pr_{0.15}Ce_{0.10})_{0.15}B_{0.07}Fe_{0.78}$ | 6.8 | 11.1 |
| 31 | $(Nd_{0.73}Pr_{0.15}Ce_{0.12})_{0.15}B_{0.07}Fe_{0.78}$ | 6.2 | 11.0 |
| 32 | $(Nd_{0.71}Pr_{0.15}Ce_{0.14})_{0.15}B_{0.07}Fe_{0.78}$ | 5.6 | 11.0 |
| 33 | $(Nd_{0.70}Pr_{0.15}Ce_{0.15})_{0.15}B_{0.07}Fe_{0.78}$ | 4.8 | 11.0 |
| 34 | $(Nd_{0.69}Pr_{0.15}Ce_{0.16})_{0.15}B_{0.07}Fe_{0.78}$ | 4.0 | 10.9 |
| 35 | $(Nd_{0.68}Pr_{0.15}Ce_{0.17})_{0.15}B_{0.07}Fe_{0.78}$ | 3.1 | 10.9 |

Figure 2:
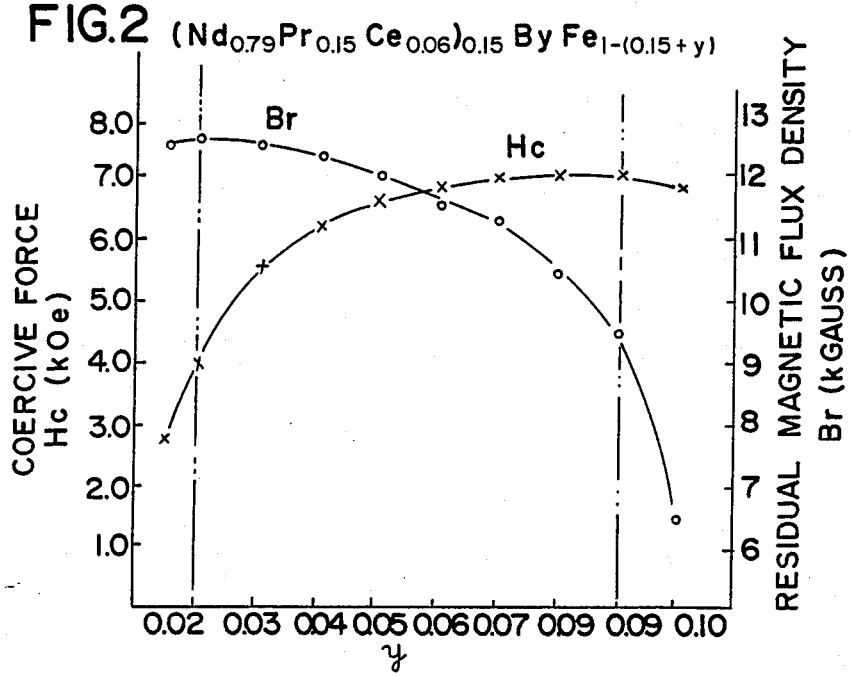
FIG. 2 is a graph for showing the influence of the value of y on the coercive force (Hc) and the residual magnetic flux density (Br) for sintered magnets having compositions $$(Nd_{0.79}Pr_{0.15}Ce_{0.06})_{0.15}B_yFe_{1-(0.15+y)};$$
Figure 3:
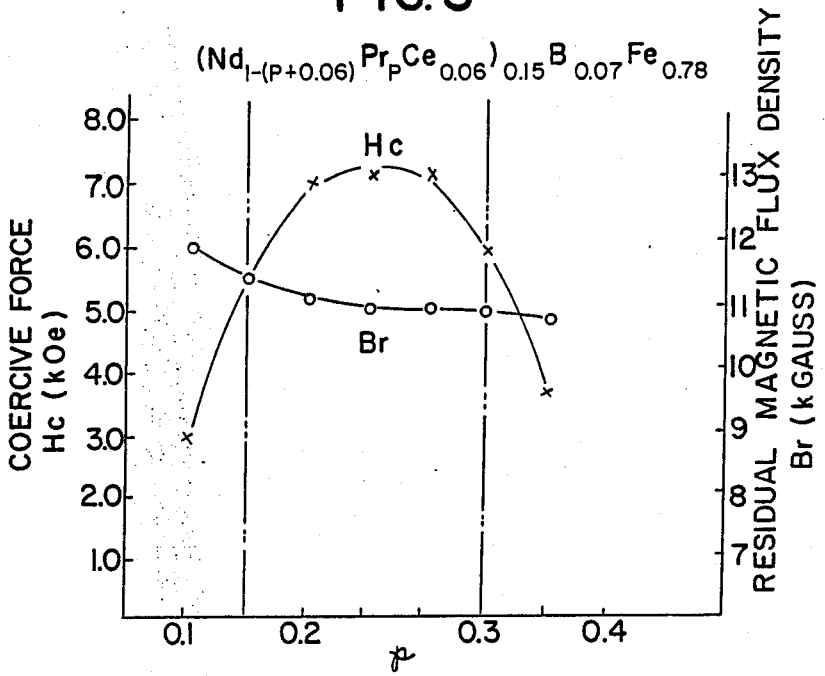
FIG. 3 is a graph for showing the influence of the value of p on the coercive force (Hc) and the residual magnetic flux density (Br) for sintered magnets having compositions $$(Nd_{1-(P+0.06)}Pr_pCe_{0.06})_{0.15}B_{0.07}Fe_{0.78};$$
Figure 4:
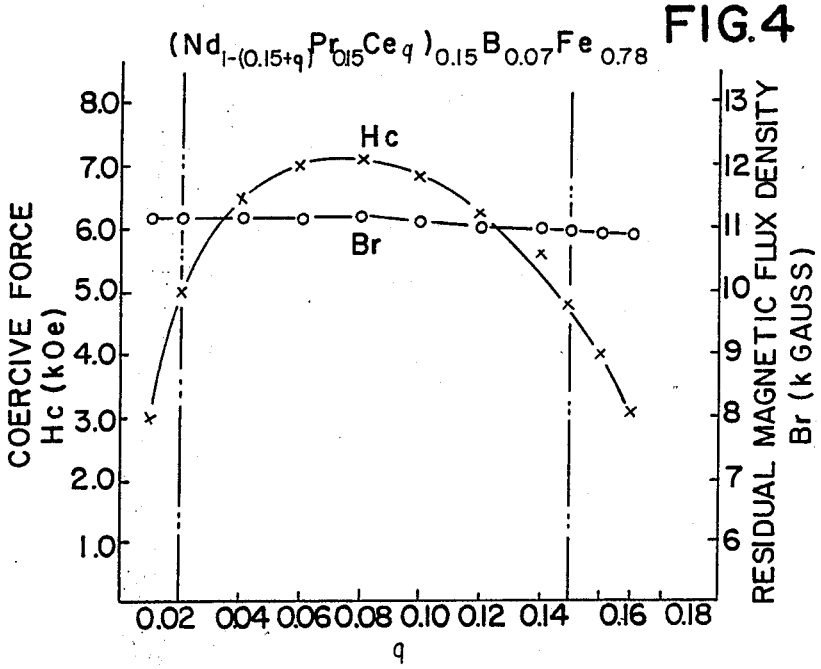
FIG. 4 is a graph for showing the influence of the value of q on the coercive force (Hc) and the residual magnetic flux density (Br) for sintered magnets having compositions $$(Nd_{1-(0.15+q)}Pr_{0.15}Ce_{0.06})_{0.15}B_{0.07}Fe_{0.78};$$

In the case of the group of Samples Nos. 1 to 7, the value of x was changed in the range from 0.05 to 0.35 for a common composition $(Nd_{0.79}Pr_{0.15}Ce_{0.06})_xB_{0.07}Fe_{1-(x+0.07)}$ and the resultant changes in magnetic properties are shown in FIG. 1. In the case of the group of Samples Nos. 8 to 17, the value of y was changed in the range from 0.015 to 0.10 for a common composition $(Nd_{0.79}Pr_{0.15}Ce_{0.06})_{0.15}B_yFe_{1-(0.15+y)}$ and the resultant changes in magnetic properties are shown in FIG. 2. In the case of the group of Samples Nos. 18 to 24, the value of p was changed in the range from 0.05 to 0.35 for a common composition $(Nd_{1-(p+0.06)}Pr_pCe_{0.06})_{0.15}B_{0.07}Fe_{0.78}$ and the resultant changes in magnetic properties are shown in FIG. 3. In the case of the group of Samples Nos. 25 to 35, the value of q was changed in the range from 0.01 to 0.17 for a common composition $(Nd_{1-(p.15+q)}Pr_{0.15}Ce_q)_{0.15}B_{0.07}Fe_{0.78}$ and the resultant changes in magnetic composition are shown in FIG. 4.

It is apparent from the data in the first group in Table 1 and FIG. 1 that the value X, which specifies the atom ratio of inclusion of the rare earth elements with respect to Fe, greatly affects the level of the coercive force (Hc), and that coercive force remains above 5 k0e when the value of x is in a range from 0.10 to 0.30. The level of the residual magnetic flux density (Br) is relatively independent of the value of x and remains about 11kG as long as the value of x is in the above-specified range.

It is clearly understood from the data in the second group in Table 1 and FIG. 2, that with respect to the value of y, which specifies the atom ratio of inclusion of B with respect to Fe, lower value of y result in lower levels of the coercive force, and that higher value of y result in lower levels of the residual magnetic flux density (Br). Compatible results are obtained when the value of y is in a range from 0.02 to 0.09, and, more preferably, from 0.04 to 0.08.

The data in the first group in Table 2 and FIG. 3 clearly indicate that the coercive force (Hc) is influenced by the value of p which specifies the atom ratio of inclusion of Pr with respect to Nd. When the value of p is in a range from 0.1 to 0.3, the coercive force (Hc) remains 5kOe or higher. The level of the residual magnetic flux density (Br) is relatively unaffected by the value of p and remains about 11kG when p is present within the above-described range.

The data in the second group in Table 2 and FIG. 4 indicates that the coercive force (Hc) varies with q which specifies the atom ratio of inclusion of Ce with respect to Nd. Values of q in a range from 0.02 to 0.15 assures a coercive force (Hc) of 5kOe or higher. The level of the residual magnetic flux density is less dependent upon the value of q and remains about 11kG as long as q is present within the above-described range.

EXAMPLE 2

Figure 5:
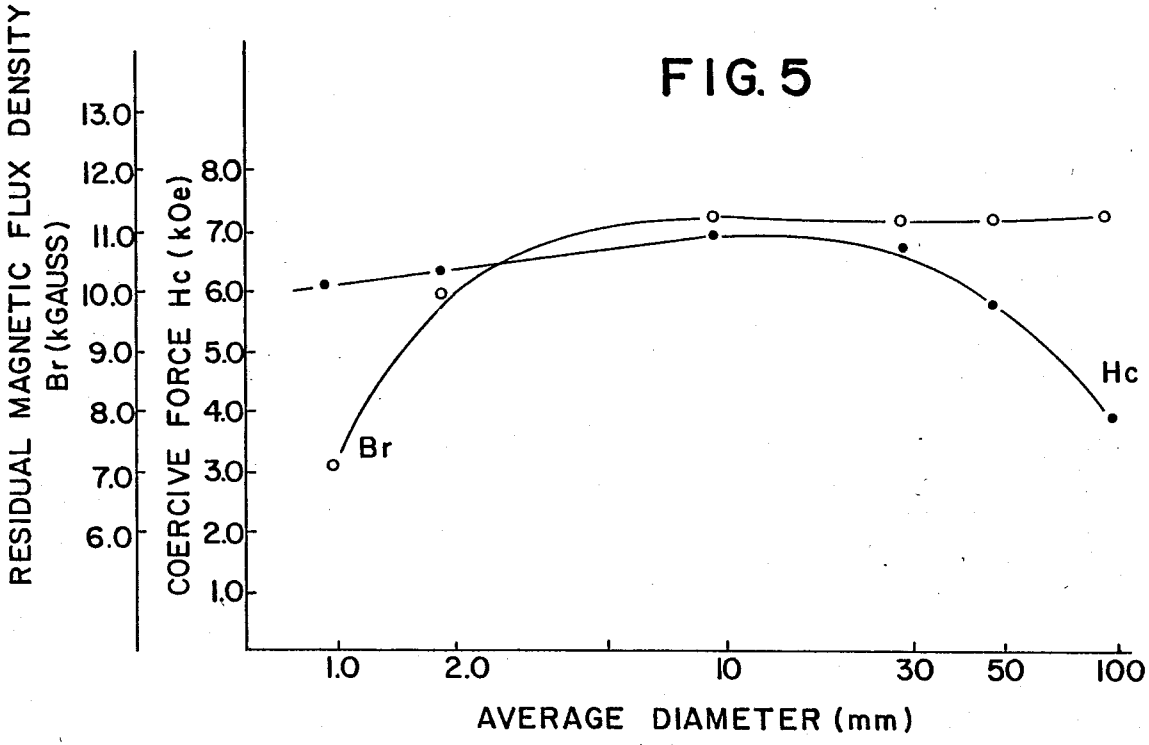
FIG. 5 is a graph for showing the influence of the average diameter of powders in the method of the present invention on the coercive force (Hc) and the residual magnetic flux density (Br) of the produced magnet.

Molten alloys having a composition $(Nd_{0.79}Pr_{0.15}Ce_{0.06})_{0.15}B_{0.07}Fe_{0.78}$ were prepared in a high frequency vacuum furnace and subjected to vacuum casting. The cast blocks were comminuted to powders (Sample Nos. 36 to 41) of 1.0 μm, 2.0μm, 10μm, 30μm, 50μm and 100μm average diameters. The powders were subjected to compaction at 5 ton/cm$^2$ pressure in a DC magnetic field of 10,000 G and compact blocks were then subjected to sintering at 1100 degrees C. for 2 hours in an argon gas environment. A test piece was cut out from each sintered magnet for measurement of magnetic properties, which are shown in Table 3 and FIG. 5.

TABLE 3

| Sample No. | Average diameter (μm) | Magnetic properties: Coercive force Hc (kOe) | Residual magnetic flux density Br (kG) |
|---|---|---|---|
| 36 | 1.0 | 6.1 | 7.0 |
| 37 | 2.0 | 6.3 | 9.9 |
| 38 | 10.0 | 6.9 | 11.2 |
| 39 | 30.0 | 6.7 | 11.1 |
| 40 | 50.0 | 5.8 | 11.2 |
| 41 | 100.0 | 3.9 | 11.2 |

It is clear from these results that an average diameter exceeding 50,μm reduces the coercive force (hc) below 5kOe and that an average diameter below 2.0,μm reduces the residual magnetic flux density (Br) below 10kG. An acceptable result is obtained when the average diameter is chosen in a range from 2.0 to 50μm.

EXAMPLE 3

Figure 6:
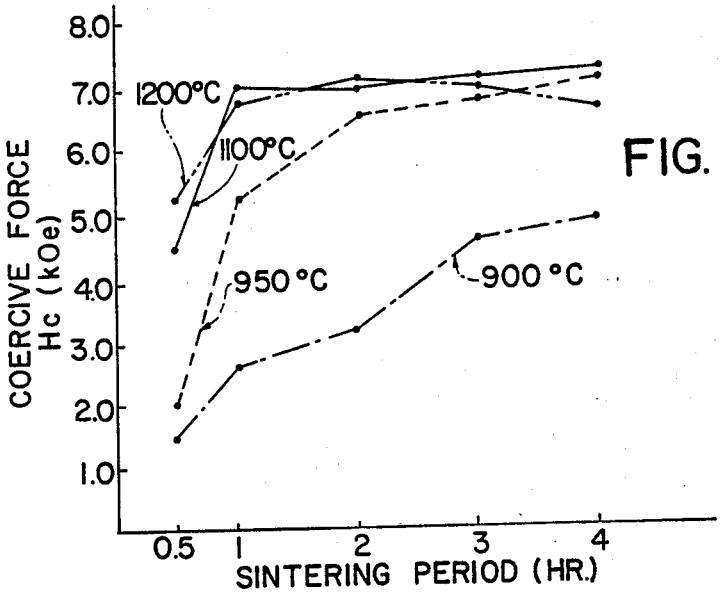
FIG. 6 is a graph for showing the influence of the sintering temperature and period in the method of the present invention on the coercive force (Hc) of the produced magnet.
Figure 7:
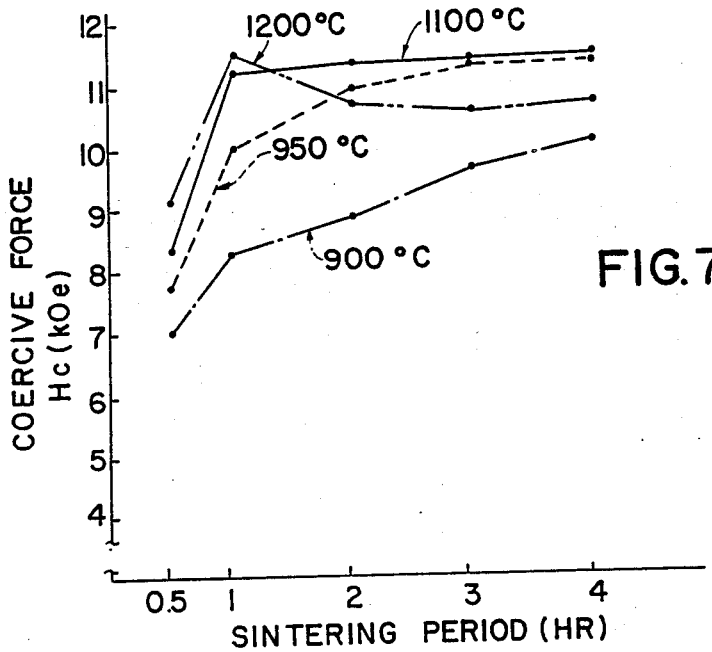
FIG. 7 is a graph for showing the influence of the sintering temperature and period in the method of the present invention on the residual magnet flux density (Br) of the produced magnet.

Powders (Sample Nos. 42 to 52) of same composition as Example 2 and 10μm average diameter were subjected to compaction at 5 ton/cm$^2$ pressure in a DC magnetic field of 10kG, and subjected, in argon gas environment, to sintering at 900, 950, 1000, 1100, 1200 and 1250 degrees C. for 0.5, 1, 2 and 4 hours. The magnetic properties of the sintered magnets thus produced were measured and are shown in Table 4, FIGS. 6 and 7.

TABLE 4

| Sample No. | Sintering conditions: Temperature (°C.) | Period (hour) | Magnetic properties: Coercive force Hc (kOe) | Residual magnetic flux density (kG) |
|---|---|---|---|---|
| 42 | 900 | 0.5 | 1.5 | 7.0 |
| 43 | | 1 | 2.6 | 8.3 |
| 44 | | 4 | 4.9 | 10.1 |
| 45 | 950 | 0.5 | 2.0 | 7.7 |
| 46 | | 1 | 5.3 | 10.0 |
| 47 | 1100 | 0.5 | 4.5 | 8.4 |
| 48 | | 1 | 7.1 | 11.2 |
| 49 | | 4 | 7.2 | 11.4 |
| 50 | 1200 | 0.5 | 5.2 | 9.1 |
| 51 | | 4 | 6.6 | 10.7 |
| 52 | 1250 | 0.5 | unmeasurable due to melting | |

These data show that sintering temperatures below 950 degrees C. results in insufficient sintering causing a low coercive force (Hc) and a low residual magnetic flux density (Br); sintering at a temperature above 1200 degrees C. causes melting of the compacted block. Also, unacceptable results are obtained when the sintering period is shorter than 1 hour.

Figure 8:
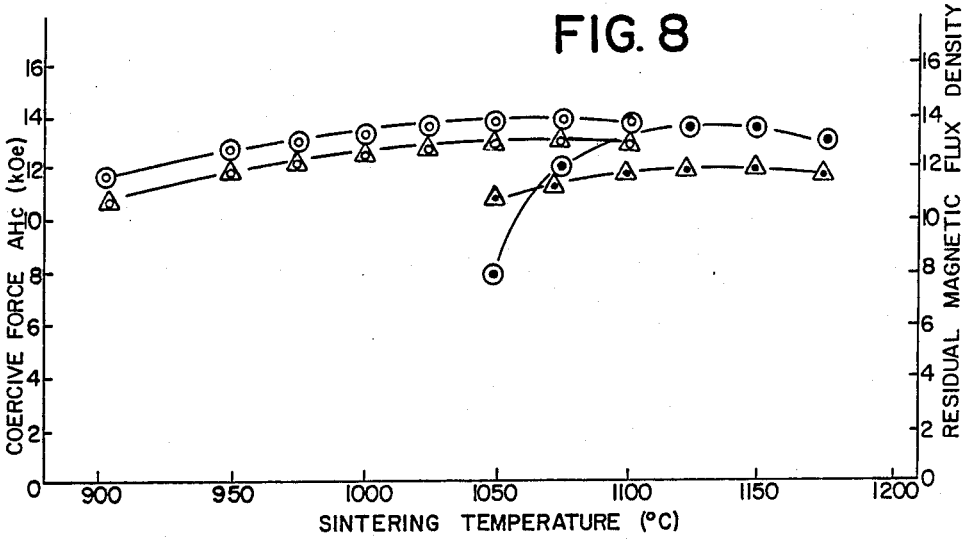
FIGS. 8 and 9 are graphs showing comparative data of magnetic properties versus sintering temperature for the magnetics of the present invention and those of the prior art.
Figure 9:
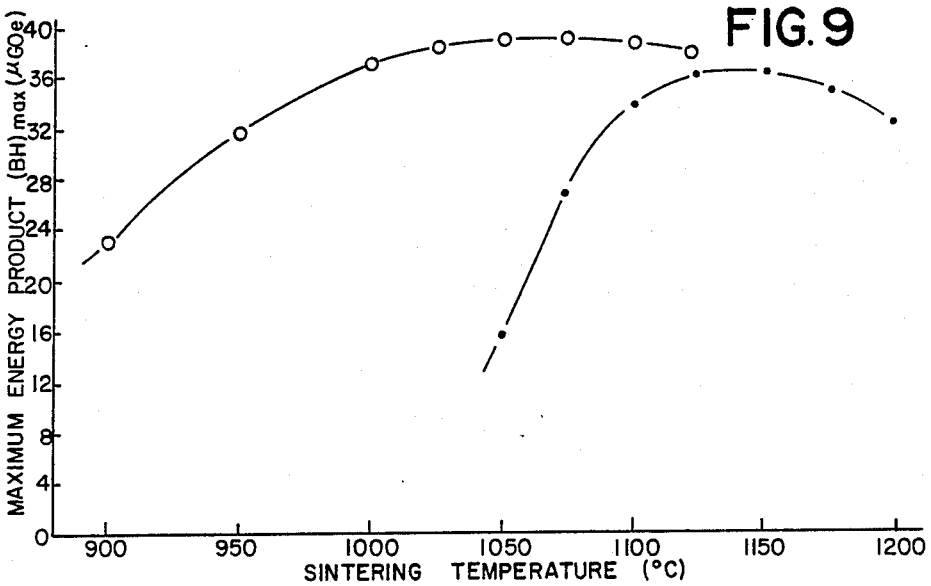

FIGS. 8 and 9 show that the rare earth magnets of Fe-B with defined combinations of Nd-Pr-Ce rare earths provide magnetic properties which are advantageous with respect to coercive force and residual magnetic flux density, and that these magnetic properties remain substantially constant within a wide range of sintering temperatures.

In particular, suitable atom ratio values of the rare earth element Ce, which provide such advantageous magnetic properties in combination with Nd and Pr are the atom ratios: Ce 0.02 to 0.15, preferably 0.04 to 0.12, and, optimally, about 0.08. Both the Hc and Br values for such compositions are quite high, that is at least 5 and 10, respectfully, and preferably 7 and 11, respectfully. Within the sintering temperature range of 950 degrees to 1150 degrees C., preferably 1050 degrees C. to 1100 degrees C., these values remain substantially unchanged.

Figure 10:
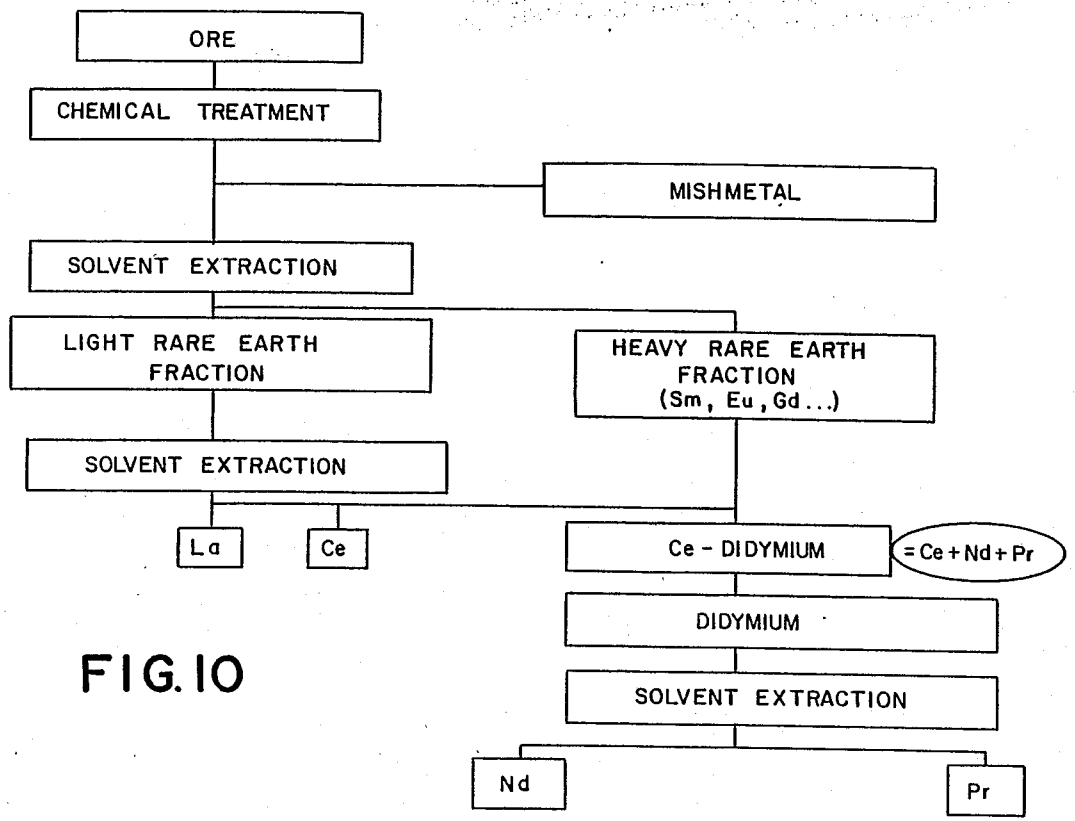
FIG. 10 is a flow diagram showing the production of the Nd-Pr-Ce rare earth combination of the invention.

The magnetic compositions of the invention also are decidedly advantageous from a commercial standpoint because the rare earth combination of Nd-Pr-Ce is available (see Flow sheet of FIG. 10) during the manufacture of rare earths from ores at an early stage in the extraction therefrom, whereas the rare earth combinations of Nd and Pr, of the prior art, is produced only later in the extraction process. Accordingly, it is desirable to use such three elements Nd-Pr-Ce combination, if possible, where its properties can be made to approach or exceed the Nd-Pr system.

What has accomplished herein is the discovery that there is a unique atom ratio range of Ce with Nd and Pr for the Fe-B type magnets which provides such useful magnetic properties, and that such properties are relatively unaffected by changes in sintering temperature.

What is claimed is:

1. A rare earth magnet article consisting essentially of the three rare earth elements Nd-Pr-Ce within defined atom ratios of each in the formula:

$$(Nd_{1-(p+q)}Pr_pCe_q)_xB_yFe_{1-(x+y)}$$

wherein $0.1 \leqq x \leqq 0.3$, $0.02 \leqq y \leqq 0.09$, $0.1 \leqq p \leqq 0.3$ and $0.02 \leqq q \leqq 0.15$;

said magnet having been prepared by melting said constituents into an alloy thereof, casting said molten alloy, comminuting said cast alloy into powders having an average diameter of 2.0 to 50 μm, compacting said powders within a magnetic field, and sintering said compacted powders at 950 degrees to 1200 degrees C. for at least 1 hour to 4 hours, the resultant magnet having a coercive force Hc of at least about 5kOe, and a residual magnetic flux density Br of at least about 10kG, which magnetic properties are substantially the same within the range of said sintering temperatures.

2. A rare earth magnet article according to claim 1 further characterized by consisting essentially of three rare earths elements Nd-Pr-Ce in which x is 0.1to 0.25, y is 0.04 to 0.08, p is 0.12 to 0.27 and q is 0.04 to 0.12, said magnet having been prepared by melting said constituents into an alloy thereof, casting said molten alloy, comminuting said cast alloy into powders having an average diameter of 3 to 30 μm, compacting said powders within a magnetic field of at least 5kOe, and sintering said compacted powders at a temperature of about 1050 to 1150 degrees C., the resultant magnet having a coercive force Hc of about 7kOe and a residual magnetic density Br of about 11kG, which properties are substantially the same within the range of said sintering temperatures.

3. A rare earth magnet article according to claim 2 wherein x is about 0.15, y is about 0.07, p is about 0.15 and q is about 0.08.

4. A rare earth magnet article according to claim 2 wherein said compacted powders have an average diameter of about 3–10 μm, and said sintering is carried out at about 1100 degrees C. for about 4 hours.

* * * * *